United States Patent [19]

Stoddart

[11] 4,417,994

[45] Nov. 29, 1983

[54] PARTICULATE DETERGENT ADDITIVE COMPOSITIONS

[75] Inventor: Barry Stoddart, Newcastle upon Tyne, England

[73] Assignee: The Procter & Gamble Company, Cincinnati, Ohio

[21] Appl. No.: 340,954

[22] Filed: Jan. 20, 1982

[30] Foreign Application Priority Data

Jan. 24, 1981 [GB] United Kingdom ..... 8102221

[51] Int. Cl.[3] ..... C11D 3/06; C11D 7/56

[52] U.S. Cl. ..... 252/135; 8/101; 8/103; 252/91; 252/95; 252/99; 252/524; 252/186.39; 252/174.13; 252/174.21; 252/174.11; 252/106; 252/174.12

[58] Field of Search ..... 252/99, 91, 524, 135, 252/174.13, 102, 186.2, 186.39; 8/103, 101, 107, 110

[56] References Cited

U.S. PATENT DOCUMENTS

| | | | |
|---|---|---|---|
| 3,784,476 | 1/1974 | van Kampen et al. | 252/109 |
| 3,846,324 | 11/1974 | Lohmann et al. | 252/95 |
| 3,925,234 | 12/1975 | Hachmann et al. | 252/186 |
| 3,927,967 | 12/1975 | Speakman | 8/103 |
| 3,950,275 | 4/1976 | Toyoda et al. | 252/527 |
| 4,009,113 | 2/1977 | Green et al. | 252/95 |
| 4,113,644 | 9/1978 | Ashcraft | 252/91 |
| 4,240,920 | 12/1980 | Luque | 252/99 |
| 4,290,903 | 12/1981 | Macgilp et al. | 252/91 |

FOREIGN PATENT DOCUMENTS

| | | |
|---|---|---|
| 48-11803 | 4/1973 | Japan . |
| 1204123 | 9/1970 | United Kingdom . |
| 1372035 | 10/1974 | United Kingdom . |

*Primary Examiner*—P. E. Willis, Jr.

[57] ABSTRACT

Detergent additive compositions having improved storage stability in granular detergent compositions comprise a storage-sensitive detergent additive material releasably enclosed within a water-soluble glassy matrix of amorphous phosphate having the formula I:

$$(M_2O)_x(P_2O_5)y \qquad \text{I}$$

wherein M is hydrogen, alkali metal, ammonium or a substituted ammonium group, y has a value in the range from 2 to 50, and the ratio of x:y is from 0.7:1 to 1.7:1. The storage sensitive additive material is preferably a multifunctional photo-activator/dye.

22 Claims, No Drawings

PARTICULATE DETERGENT ADDITIVE COMPOSITIONS

TECHNICAL FIELD

The present invention relates to detergent additive compositions, methods for making thereof, and use thereof in granular detergent compositions. In particular, it relates to detergent additive compositions having improved storage stability within a full detergent composition.

BACKGROUND

It is widely recognized that the function of a detergent additive material can be significantly impaired in a detergent composition by interaction between the additive material and other components of the composition. For example, enzymes, perfumes and bleach activators can be deleteriously effected by interaction with peroxy bleaches; cationic fabric conditioners can be deleteriously effected by interaction with anionic surfactants; and fluorescers can be deleteriously effected by interaction with peroxy bleaches or cationic surfactants. Moreover, the consumer acceptability of a product can also be significantly reduced as the result of physical interactions between a detergent additive and other components of a detergent composition. For instance, a speckled detergent containing a water-soluble dye can lose its aesthetic appeal as a result of migration of the dye into the detergent base powder, an effect which can be significantly enhanced by the presence in the detergent composition of a nonionic surfactant component. Physical segregation problems in the case of abnormally-sized additive materials can also contribute to reduced aesthetic appeal and effectiveness of a detergent composition.

The Applicants have now discovered that detergent additive materials having improved storage stability in a detergent composition, can be provided by releasably enclosing the additive material within a glassy matrix of amorphous phosphate material. The idea of coating, agglomerating or encapsulating sensitive ingredients to provide improved storage stability is well known, of course. Conventionally, organic materials have found the greatest favour as coating agents because such materials readily form the substantially continuous barrier necessary for effective stabilization of the additive material. British Pat. Nos. 1,204,123, 1,441,416 and 1,395,006 are representative of this general approach. However, organic coating materials suffer the disadvantage that, to be efficaceous, the coating material must be so water impervious (i.e., hydrophobic) and also possibly so high melting as to inhibit considerably the rate of release of the additive material into a detergent wash liquor. By contrast, the coating materials of the present invention provide a matrix which effectively encloses and protects the detergent additive material, yet which is readily water-soluble and provides for rapid release of the additive material into a bulk detergent liquor.

SUMMARY OF THE INVENTION

Accordingly, the present invention provides a detergent additive composition in particulate form comprising:

(a) a storage-sensitive detergent additive material releasably enclosed within (b) a water-soluble glassy matrix of amorphous phosphate having the general formula I:

$$(M_2O)_x(P_2O_5)_y \quad \text{I}$$

wherein M is hydrogen, alkali metal, ammonium or a substituted ammonium group, y has a value in the range from 2 to about 50, and the ratio x:y is from about 0.7:1 to about 1.7:1.

The storage sensitive detergent additive material can be a unifunctional or multifunctional material and is preferably selected from photoactivators, fluorescers, bleaching auxiliaries, dyes, perfumes, germicides, enzymes and fabric conditioners. Preferred detergent additive materials have a solubility in distilled water at 25° C. of at least $1.10^{-5}$% preferably at least about $5.10^{-4}$% by weight.

The invention is especially suited to the stabilization of multifunctional photoactivator/dyes belonging to the porphine class of general formula II.

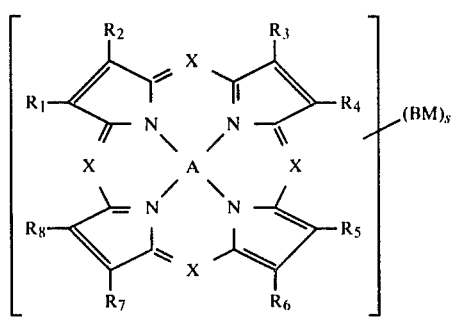

II wherein each X is (=N—) or (=CY—), and the total number of (=N—) groups is 0, 1, 2, 3 or 4; wherein each Y, independently, is hydrogen or meso substituted alkyl, cycloalkyl, aralkyl, aryl, alkaryl or heteroaryl; wherein each R, independently, is hydrogen or pyrrole substituted alkyl, cycloalkyl, aralkyl, aryl, alkaryl or heteroraryl, or wherein adjacent pairs of R's are joined together with orthoarylene groups to form pyrrole substituted alicyclic or heterocyclic rings; wherein A is 2(H) atoms bonded to diagonally opposite nitrogen atoms, or Zn(II), Cd(II), Mg(II), Ca(II), Al(III), Sc(III), or Sn(IV); wherein B is an anionic or cationic solubilizing group substituted into Y or R; wherein M is a counterion to the solubilizing groups; and wherein s is the number of solubilizing groups; wherein, when B is cationic, M is an anion and s is from 1 to 8; when B is nonionic, B is polyethoxylate, M is zero, s is from 1 to 8, and the number of condensed ethylene oxide molecules per porphine molecule is from 8 to 50; when B is anionic and proximate, M is cationic and s is from 3 to 8; when B is anionic and remote, M is cationic and s is from 2 to 8; and when B is sulphonate the number of sulphonate groups is no greater than the number of aromatic and heterocyclic substituent groups.

Highly preferred materials of this general type are the zinc phthalocyanine tri- and tetrasulphonates and mixtures thereof. These materials are discussed in detail in European Patent Application 3861.

Regarding the amorphous phosphate, this preferably has a y value in the range from about 3 to about 30 and an x:y ratio in the range from about 0.85 to about 1.5. In highly preferred embodiments, the amorphous phosphate has a y value in the range from about 6 to about 15 with an x:y ratio in the range from about 1 to about 1.3. Suitably, the amorphous phosphate has a dissolution rate in distilled water at 25° C. such that the time for 90% dissolution of the phosphate is in the range from about 5 minutes to about 2 hours, preferably from about 8 minutes to about 20 minutes. Dissolution rate is measured on 1.5 g samples of phosphate in the form of particles of seive size thru' 20# on 30# mesh (841–595 μm), the phosphate being added to 15 ml of water in 20 ml vials, stirring being effected by rotation of a wheel to the circumference of which the vials are attached radially.

The amorphous phosphate is present in the detergent additive compositions of the invention in relatively minor levels. Generally, the phosphate comprises from about 1% to about 15% by weight of the particles of the detergent additive composition, preferably from about 3% to about 10% and more preferably from about 5% to about 8% by weight thereof. The detergent additive composition itself suitably has an average particle size of from about 250 μm to about 3000 μm, more preferably from about 500 μm to about 2000 μm.

The detergent additive composition preferably comprises the storage-sensitive detergent additive material in the form of an intimate mixture with a hydratable water-soluble crystalline salt. The mixture of additive material and crystalline salt is then releasably enclosed within a substantially continuous glassy matrix of amorphous phosphate material. Although the crystalline salt is hydratable, it is preferably present in at least partially hydration form in the intimate mixture, for instance, hydration to an extent of about 40% to about 75%, more preferably from about 50% to about 70% of its theoretical maximum hydration capacity. A highly preferred crystalline salt is pentasodium tripolyphosphate hydrated to an extent of about 55% to about 65% of its maximum hydration capacity.

In the case of porphine-type photoactivator/dye materials disclosed above, the invention is of particular advantage in formulating additive compositions, such as speckles and the like, having reduced tendency to "bleed" when added to a detergent composition comprising a nonionic surfactant. Preferably, bleeding is reduced to an extent such that when the particulate detergent additive composition is added to a mixed solvent containing the nonionic surfactant and water in a 100:6 ratio at 40° C., the rate of bleed is reduced by a factor of at least 3 compared with the rate for a corresponding additive composition free of the amorphous phosphate material.

The present invention also provides a method for making the detergent additive compositions of the invention including the step of enrobing the storage-sensitive additive material with a continuous glassy matrix of the amorphous phosphate. A preferred method comprises spraying an aqueous solution comprising the amorphous phosphate onto moving granules of a mixture of the storage-sensitive detergent additive material and a hydratable water-soluble salt, thereby enrobing the additive material with a continuous glassy matrix of the amorphous phosphate.

The present invention further provides granular detergent compositions containing the detergent additive compositions described herein. Preferred granular detergent compositions comprise a nonionic surfactant, especially preferred compositions comprising:

(a) from about 40% to about 87.9% of spray-dried base powder comprising (i) from about 1% to about 20% of organic surfactant selected from anionic, zwitterionic and ampholytic surfactants and mixtures thereof, (ii) from about 5% to about 81.9% of detergency builder, and (iii) from about 5% to about 18% moisture, (b) from about 0.1% to about 20% of the detergent additive composition, and (c) from about 2% to about 25% of ethoxylated nonionic surfactant in intimate mixture with the spray-dried base powder and detergent additive composition.

The individual components of the invention will now be discussed in detail.

A preferred class of detergent additive material is a photoactivator of the porphine-type. Materials of this general class were originally disclosed for use in detergent compositions in British Pat. Nos. 1,372,035 and 1,408,144. The photoactivators can provide fabric bleaching effects in built detergent compositions in the presence of visible light and atmospheric oxygen and can also synergistically enhance the bleaching effect of conventional bleaching agents such as sodium perborate. The porphine bleach is preferably used in an amount such that the level of porphine in final detergent composition is in the range from about 0.001% to about 0.5%, more preferably from about 0.002% to about 0.02%, especially from about 0.003% to about 0.01% by weight.

The porphines useful in the present invention are species of various substituted porphines. One form of substitution involves substituting 1, 2, 3 or 4 aza groups (=N—) for the methine group (=CH—) in porphine. Substitution at hydrogen atoms of the pyrrole ring can also be undertaken, for instance by aliphatic or aromatic groups, or by ortho-fused polycyclic substituents. An example of the latter is phthalocyanine (viz tetrabenzotetraazaporphine). So-called meso substitution of the methine hydrogen atoms is also possible, as well as metallation by a heavy metal atom in a chelation structure, and substitution of the porphine by solubilizing groups such as carboxylate, sulphate, phosphate and sulphonate, polyethoxylates and 'onium salts. As used herein, a solubilizing group attached to a carbon atom of the porphine molecule displaced more than 5 atoms away from the porphine core is referred to as "remote"; otherwise it is known as "proximate".

Suitable photoactivators of the porphine class include the sodium salts of zinc phthalocyanine tetrasulphonate, zinc phthalocyanine trisulphonate and calcium phthalocyanine tetrasulphonate; α,β, γ,δ-tetrakis(4-carboxyphenyl)porphine tetrasodium salt and the corresponding zinc chelate; α,β, γ,δ-tetrakis(4-N-methyl pyridyl)-porphine tetra (4-toluene sulphonate) salt and the corresponding zinc chelate; tetra (2-sulphatoethyl sulphonamidobenzo) tetraaza porphine zinc, tetrasodium salt; tetrasulphobenzotriaza porphine, tetrasodium salt; tetra(4-sulphophenyl) porphine tetraammonium salt and the corresponding zinc chelate; benzotrisulphobenzo monoaza porphine magnesium, trilithium salt; tetrasulphobenzo diaza porphine scandium, tetra (ethanolamine) salt; trans-dichloro, trisulphobenzotri(sulpho-2-pyridyl)-2-pyridyl prophine tin (IV), hexapotassium salt; 1,2,3,4,5,6,7,8-octasulphophenyl porphine cadmium, octasodium salt; tetrabenzo-α,β,γ,δ-tetrakis(4,N-ethyl)pyridyl porphine tetraiodide; 1,3,5,7-tetrakis (sulphato polyethoxy phenyl)-α,β,γ,δ-tetrakis (phosphato napthyl) porphine, octapotassium salt; trans dichloro, di(N-methyl pyrido)-α,βγ,δ-tetrakis (carboxyphenyl)

porphine tin (IV), tetraammonium salt; 1,3,5-tri(4-polyethoxy)-α,β,γ-tri-(4-polyethoxy)-δ-azaporphine; bromo, tetrabenzo-α-(4-N-methyl) pyridyl-α,γ,δ-pyridyl porphine scandium monobromide; and 2,4,6,8-tetrakis (sulphophenyl-N-heptyl) tetraaza porphine, tetra (monoethanolamine) salt.

The porphine is preferably incorporated into the detergent additive composition as an intimate mixture with a hydratable water-soluble crystalline salt, especially tetrasodium tripolyphosphate hydrated to an extent of about 55% to about 65% of its maximum hydration capacity. After treatment with amorphous phosphate, the additive composition will preferably comprise from about 0.05% to 2%, more preferably from about 0.1% to 0.5% by weight of porphine, from about 1% to about 20%, more preferably from about 3% to about 10% by weight of amorphous phosphate, and the remainder tripolyphosphate and water. Addition of the amorphous phosphate is preferably undertaken by spraying an aqueous solution containing from about 5% to about 70%, more preferably from about 30% to about 60% of the amorphous phosphate onto moving granules of the mixture of porphine and tripolyphosphate in a rotating drum or the like.

The invention can also be applied to give improved additive compositions based on enzymes, fluorescers, perfumes, suds suppressors, fabric conditioners, soil suspending agents, bleach activators, peroxyacid bleaches and the like.

Preferred enzymatic materials include the commercially available amylases and neutral and alkaline proteases conventionally incorporated into detergent compositions. Suitable enzymes are discussed in U.S. Pat. Nos. 3,519,570 and 3,533,139. Examples of suitable enzymes include the materials sold under the Registered Trade Marks Maxatase and Alcalase.

Anionic fluorescent brightening agents are well-known materials, examples of which are disodium 4,4'-bis-(2-diethanolamino-4-anilino-s-triaxin-6-ylamino) stilbene-2:2' disulphonate, disodium 4,4'-bis-(2-morpholino-4-anilino-s-triazin-6-ylaminostilbene-2:2' disulphonate, disodium 4,4'-bis-(2,4-dianilino-s-triazin-6-ylamino)stilbene-2:2'-di-sulphonate, disodium 4,4'-bis-(2-anilino-4-(N-methyl-N-2-hydroxyethylamino)-s-triazin-6-ylamino)stilbene-2,2'-disulphonate, disodium 4,4'-bis-(4-phenyl-2,1,3-triazol-2-yl)-stilbene-2,2'-disulphonate, disodium 4,4'-bis(2-anilino-4-(1-methyl-2-hydroxyethylamino)-s-triazin-6-ylamino)stilbene-2,2'disulphonate and sodium 2(stilbyl-4''-(naptho-1',2':4,5)-1,2,3-triazole-2''-sulphonate.

Other fluorscers to which the invention can be applied include the 1,3-diaryl pyrazolines and 7-alkylaminocoumarins.

Bleach activators suitable in the compositions of the invention are organic peroxyacid precursors including esters such as trichloroethyl acetate, acetylacetohydroxamic acid, sodium p-acetoxy benzene sulphonate sodium benzoyl phenol sulphonate, methyl o-acetoxy benzoate and Bisphenol A diacetate; imides such as N-acetyl caprolactam, N-benzene sulphonyl phthalimide, tetraacetylethylenediamine, tetraacetylmethylenediamine, tetraacetylhexamethylenediamine and tetraacetylglycouril; imidazoles such as N-acetylbenzimidazole; oximes such as diacetyl dimethyl glycoxime; as well as certain carbonates, guanidines and triazine derivatives.

Suds suppressors can also be incorporated in the compositions of the invention, especially materials of the silicone, wax, ester or hydrocarbon oil types. Silicone materials can be represented by alkylated polysiloxane materials possibly absorbed onto a solid substrate such as silica aerogels and xerogels and hydrophobic silicas of various types. The silicone material can be described as siloxane having the formula:

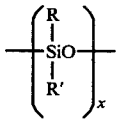

wherein x is from about 20 to about 2,000 and R and R' are each alkyl or aryl groups, especially methyl, ethyl, propyl, butyl and phenyl. The polydimethyl siloxanes (R and R' are methyl) having a molecular weight within the range of from about 200 to about 2,000,000, and higher, are all useful as suds controlling agents. Additional suitable silicone materials wherein the side chain groups R and R' are alkyl, aryl, or mixed alkyl or aryl hydrocarbyl groups exhibit useful suds controlling properties. Examples of the like ingredients include diethyldipropyl-, dibutyl-, methyl-, ethyl-, phenylmethylpolysilixanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2/g$ intimately admixed with dimethyl silicone fluid having a molecular weight in the range from about 500 to about 200,000 at a weight ratio of silicone to silanated silica of from about 1:1 to about 1:10.

Particularly useful suds suppressors are the self-emulsifying silicone suds suppressors, described in German Patent Application DTOS No. 2,646,126 published Apr. 28, 1977 and incorporated herein by reference. An example of such a compound is DC-544, commercially available from Dow Corning, which is a siloxane/-glycol copolymer.

Other suitable suds suppressors include microcrystalline waxes as disclosed in British Pat. No. 1,492,938, hydrocarbon oils and esters as disclosed in British patent application No. 2,040,982, and $C_{18}$–$C_{22}$ fatty acids.

The detergent additive compositions of the invention are incorporated in granular detergent compositions of conventional type. These can contain from about 3% to about 45%, preferably from about 5% to about 30%, more preferably from about 8% to about 20% of organic surfactant selected from anionic, nonionic, zwitterionic and ampholytic surfactants and mixtures thereof. A typical listing of the classes and species of these surfactants is given in U.S. Pat. No. 3,663,961 issued to Norris on May 23, 1972 and incorporated herein by reference.

Suitable synthetic anionic surfactants are water-soluble salts of alkyl benzene sulfonates, alkyl sulfates, alkyl polyethoxy ether sulfates, paraffin sulfonates, alpha-olefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonate, and beta-alkyloxy alkane sulfonate.

A particularly suitable class of anionic detergents includes water-soluble salts, particularly the alkali metal, ammonium and alkanolammonium salts or organic sulfuric reaction products having in their molecular structure an alkyl or alkaryl group containing from about 8 to about 22, especially from about 10 to about 20 carbon atoms and a sulfonic acid or sulfuric acid ester group. (Included in the term "alkyl" is the alkyl portion of acyl groups). Examples of this group of synthetic detergents which form part of the detergent compositions of the present invention are the sodium and potassium alkyl sulfates, especially those obtained by sulfating the higher alcohols ($C_8$–$C_{18}$) carbon atoms produced by reducing the glycerides of tallow or coconut oil and sodium and potassium alkyl benzene sulfonates, in which the alkyl group contains from about 9 to about 15, especially about 11 to about 13, carbon atoms, in straight chain or branched chain configuration, e.g. those of the type described in U.S. Pat. No. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$ LAS.

Other anionic detergent compounds herein include the sodium $C_{10}$–$C_{18}$ alkyl glyceryl ether sulfones, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts or esters of $\alpha$-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 24, preferably about 14 to 16, carbon atoms, especially those made by reaction with sulfur trioxide followed by neutralization under conditions such that any sultones present are hydrolysed to the corresponding hydroxy alkane sulfonates; water-soluble salts of paraffin sulfonates containing from about 8 to 24, especially 14 to 18 carbon atoms, and $\beta$-alkyloxy alkane sulfonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Magnesium and calcium are preferred cations under circumstances described by Belgian Pat. No. 843,636 invented by Jones et al, issued Dec. 30, 1976. Mixtures of anionic surfactants are contemplated by this invention; a preferred mixture contains alkyl benzene sulfonate having 11 to 13 carbon atoms in the alkyl group or paraffin sulfonate having 14 to 18 carbon atoms and either an alkyl sulfate having 8 to 18, preferably 12 to 18, carbon atoms in the alkyl group, or an alkyl polyethoxy alcohol sulfate having 10 to 16 carbon atoms in the alkyl group and an average degree of ethoxylation of 1 to 6.

Ethoxylated nonionic surfactants materials can be broadly defined as compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements. In general, ethoxylated nonionic surfactants suitable herein have an average ethyleneoxy content in the range from about 35% to about 70% and especially from about 50% to about 62.5% by weight of the surfactant. In this context, it should be understood that while ethoxylated nonionic surfactants having an ethyleneoxy content of less than about 62.5% are optimum from the viewpoint of overall detergency performance in compositions containing nonionic surfactant as the major surfactant component, the relatively hydrophobic nature of these surfactants tends to exacerbate the problems of perborate insolubilization described above. In other words, the invention is of particular value for just those surfactants which otherwise provide optimum performance from a detergency viewpoint.

Examples of suitable nonionic surfactants include the condensation products of primary or secondary aliphatic alcohols having from 8 to 24 carbon atoms, in either straight chain or branched chain configuration, with from 2 to about 18 moles of alkylene oxide per mole of alcohol. Preferably, the aliphatic alcohol comprises between 9 and 15 carbon atoms and is ethoxylated with between 2 and 9, desirably between 3 and 8 moles of ethylene oxide per mole of aliphatic alcohol. Such nonionic surfactants are preferred from the point of view of providing good to excellent detergency performance on fatty and greasy soils, and in the presence of hardness sensitive anionic surfactants such as alkyl benzene sulfonates. The preferred surfactants are prepared from primary alcohols having no more than about 50% chain branching, ie. which are either linear (such as those derived from natural fats or, prepared by the Ziegler process for ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 40% to 50% 2-methyl branching (Synperonic is a Trade Name of I.C.I.) Specific examples of nonionic surfactants falling within the scope of the invention include Dobanol 45-4, Dobanol 45-7, Dobanol 45-9, Dobanol 91-3, Dobanol 91-6, Dobanol 91-8, Synperonic 6, Synperonic 9, the condensation products of coconut alcohol with an average of between 5 and 9 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, for example, those ethoxylates of the Tergitol series having from about 9 to 15 carbon atoms in the alkyl group and up to about 11, especially from about 3 to 9, ethoxy residues per molecule.

Of the above, highly preferred are alkoxylated nonionic surfactants having an average HLB in the range from about 9.5 to 13.5, especially 10 to 12.5. Highly suitable nonionic surfactants of this type are ethoxylated primary $C_{9-15}$ alcohols having an average degree of ethoxylation from about 2 to 9, more preferably from about 3 to 8.

Suitable ampholytic surfactants are water-soluble derivatives of aliphatic secondary and tertiary amines in which the aliphatic moiety can be straight chain or branched and wherein one of the aliphatic substituents contains from about 8 to 18 carbon atoms and one contains an anionic water-solubilizing group, e.g. carboxy, sulfonate, sulfate, phosphate, or phosphonate.

Suitable zwitterionic surfactants are water soluble derivatives of aliphatic quaternary ammonium phosphonium and sulfonium cationic compounds in which the aliphatic moieties can be straight chain or branched, and wherein one of the aliphatic substituents contains from about 8 to 18 carbon atoms and one contains an anionic water-solubilizing group.

The degergent compositions of the invention can also contain from about 5% to about 81.9% of detergency builder, preferably from about 20% to about 70% thereof.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates and bicarbonate.

Examples of suitable organic alkaline detergency builder salts are:

(1) water-soluble amino polyacetates, e.g. sodium and potassium ethylendiaminetetraacetates, nitrilotriacetates, and N-(2-hydroxyethyl)nitrilodiacetates;

(2) water-soluble salts of phytic acid, e.g. sodium and potassium phytates;

(3) water-soluble polyphosphonates, including, sodium, potassium and lithium salts of ethane-1-hydroxy-1,1-diphosphonic acid; sodium, potassium and lithium salts of methylenediphosphonic acid and the like.

(4) water-soluble polycarboxylates such as the salts of lactic acid, glycollic acid and ether derivatives thereof as disclosed in Belgian Patents 821,368, 821,369 and 821,370; succinic acid, malonic acid, (ethylenedioxy) diacetic acid, maleic acid, diglycollic acid, tartaric acid, tartronic acid and fumaric acid; citric acid, aconitic acid, citraconic acid, carboxymethyloxysuccinic acid, lactoxysuccinic acid, and 2-oxy-1,1,3-propane-tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane-cis, cis, cis-tetracarboxylic acid, cyclopentadienide pentacarboxylic acid, 2,3,4,5-tetrahydrofuran-cis, cis, cis-tetracarboxylic acid, 2,5-tetrahydrofuran-cis-dicarboxylic acid, 1,2,3,4,5,6-hexane-hexacarboxylic acid, mellitic acid, pyromellitic acid and the phthalic acid derivatives disclosed in British Pat. 1,425,343.

Mixtures of organic and/or inorganic builders can be used herein. One such mixture of builders is disclosed in Canadian Pat. No. 755,038, e.g. a ternary mixture of sodium tripolyphosphate, trisodum nitrilotriacetate, and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British patent Specification No. 1,429,143 published Mar. 24, 1976, German patent application No. OLS 2,433,485 published Feb. 6, 1975, and OLS 2,525,778 published Jan. 2, 1976, the disclosures of which are incorporated herein by reference.

Another suitable component of the present compositions is a water-soluble magnesium salt which is added at levels in the range from about 0.015% to about 0.2%, preferably from about 0.03% to about 0.15% and more preferably from about 0.05% to about 0.12% by weight of the compositions (based on weight of magnesium). Suitable magnesium salts include magnesium sulfate, magnesium sulfate heptahydrate, magnesium chloride, magnesium chloride hexahydrate, magnesium fluoride and magnesium acetate. Desirably, the magnesium salt is added to the compositions as part of the aqueous slurry crutcher mix and is then converted to dry granular form, for instance by spray drying. The magnesium salt can provide additional low temperature stain removal benefits as described in copending British Patent Application No. 80/15542.

The detergent compositions of the invention can also be supplemented by bleaches, especially sodium perborate tetrahydrate or sodium percarbonate at levels from about 5% to about 50%. The compositions also preferably include from about 0.05% to about 0.6% (acid basis), preferably from about 0.06% to about 0.3% of aminopolyphosphonic acid, or salt thereof, having the general formula:

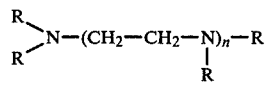

wherein n is an integral number from 0 to 3, and each R is individually hydrogen or $CH_2PO_3H_2$ provided that at least half of the radicals represented by R are $CH_2PO_3H_2$. Preferred aminopolyphosphonic acids are selected from nitrilotri(methylenephosphonic acid), ethylene-diaminetetra(methylenephosphonic acid), diethylenetriamine(pentamethylenephosphonic acid), and mixtures thereof.

An alkali metal, or alkaline earth metal, silicate can also be present. The alkali metal silicate is preferably from about 3% to about 8%. Suitable silicate solids have a molar ratio of $SiO_2$/alkali metal$_2$O in the range from about 1.0 to about 3.3, more preferably from 1.5 to 2.0. Other suitable ingredients include soil-suspending agents such as the water-soluble salts of carboxymethyl cellulose and of methyl vinylether/maleic anhydride copolymer, nonionic cellulose materials such as hydroxyethyl cellulose, and polyethylene glycols.

In the Examples which follow, the abbreviations used have the following designation:

| | |
|---|---|
| LAS | Linear $C_{11.8}$ alkyl benzene sulphonate |
| TAS | Sodium tallow alcohol sulphate |
| $CnAE_6$ | Coconut alcohol ethoxylated with 6 moles of ethylene oxide per mole of alcohol |
| Dobanol 45-E-7 | A $C_{14-15}$ oxo-alcohol with 7 moles of ethylene oxide, marketed by Shell. |
| Dobanol 45-E-4 | A $C_{14-15}$ oxo-alcohol with 4 moles of ethylene oxide, marketed by Shell. |
| TAED | Tetraacetyl ethylene diamine. |
| Silicate | Sodium silicate having an $SiO_2$: $Na_2O$ ratio of 1.6. |
| Wax | Microcrystalline wax - Witcodur 272 M. pt 87° C. |
| Silicone Prill | Comprising 0.14 parts by weight of an 85:15 by weight mixture of silanated silica and silicone granulated with 1.3 parts of sodium tripolyphosphate, and 0.56 parts of tallow alcohol condensed with 25 molar proportions of ethylene oxide. |
| Gantrez AN 119 | Trade Name for maleic anhydride/vinyl methyl ether copolymer, believed to have an average molecular weight of about 240,000, marketed by GAF. This was prehydrolysed with NaOH before addition. |
| Brightener | Disodium 4,4'-bis(2-morpholino-4-anilino-s-triazin-6-ylamino) stilbene-2:2'-disulphonate. |
| Dequest 2060 | Trade Name for diethylene triamine penta (methylene phosphonic acid) marketed by Monsanto. |
| Dequest 2041 | Trade Name for ethylenediamine tetra (methylene phosphonic acid) marketed by Monsanto. |

The present invention is illustrated by the following non-limiting examples:

EXAMPLES I TO X

A detergent additive composition according to the invention is prepared as follows. Anhydrous granular pentasodium tripolyphosphate (85 parts) is mixed with zinc phthalocyanine tetrasulphonate, tetrasodium salt (0.2 parts) in a rotating drum and water (14.8 parts) is sprayed onto the granular mixture to prepare a cogranulate of the phthalocyanine and tripolyphosphate. A 50% aqueous solution of amorphous phosphate having a y value of about 3 and an x:y ratio of about 1.0, is then sprayed onto the cogranulate in the drum, thereby forming a glassy matrix of amorphous phosphate material comprising about 6.5% by weight of the final coated cogranulate. The process is repeated replacing the amorphous phosphate by a second phosphate sample having a y value of 7 and an x:y ratio of 1.14 (Example II); a third phosphate sample having a y value of 5 and an x:y ratio of 1.2 (Example III); and a fourth phosphate sample having a y value of 10.5 and an x:y ratio of 1.1 (Example IV). The process is repeated replacing the tripolyphosphate in Example I with anhydrous sodium sulphate (Example V). The process is repeated replacing the phthalocyanine in Example I with calcium phthalocyanine tetrasulphonate, tetrasodium salt (Example VI); $\alpha,\beta,\gamma,\delta$-tetrakis(4-carboxyphenyl)porphine tetrasodium salt (Example VII); $\alpha,\beta,\gamma,\delta$-tetrakis(4-N-methyl pyridyl)porphine zinc tetra (4-toluene sulphonate) salt (Example VIII); tetra (2-sulphatoethyl sulphonamidobenzo) tetraaza porphine zinc, tetrasodium salt (Example IX); and tetrasulphobenzotriaza porphine, tetrasodium salt (Example X).

EXAMPLES XI TO XVI

The following granular detergent compositions are prepared by mixing all ingredients, apart from nonionic surfactant, bleach, silicone prill, enzyme and detergent additive composition, in a crutcher as an aqueous slurry, spray drying the slurry at high temperatures in a spray-drying tower, admixing the bleach, silicone prill, enzyme and additive composition with the spray-dried base powder, and spraying the nonionic surfactant onto the resulting granular mixture.

| | Examples | | | | | |
|---|---|---|---|---|---|---|
| | XI | XII | XIII | XIV | XV | XVI |
| LAS | 4 | 1.5 | — | — | 1.5 | 4.5 |
| TAS | — | — | 3 | — | — | 3.0 |
| $CnAE_6$ | — | — | 5 | — | 10 | — |
| Dobanol 45-E-7 | 8 | 8 | — | 12 | — | 8.5 |
| Dobanol 45-E-4 | — | 2 | — | 3 | 2 | — |
| TAED | — | 5 | — | 2 | — | — |
| Silicate | 5 | 7 | 10 | 4 | 2 | 6 |
| Wax | 0.6 | — | — | 0.5 | — | 0.4 |
| Silicone Prill | — | 1 | 1.5 | — | 2.0 | — |
| Gantrez AN119 | 0.4 | — | — | 1.5 | — | 0.8 |
| Brightener | 0.2 | 0.1 | 0.5 | 0.3 | 0.5 | 0.2 |
| Dequest 2060 | — | 0.2 | 0.25 | — | 0.1 | — |
| Dequest 2041 | 0.1 | — | — | 0.09 | — | 0.45 |
| EDTA | 0.2 | — | — | 0.1 | — | — |
| Sodium perborate tetrahydrate | 24 | 10 | 20 | 25 | 15 | 22 |
| Alcalase enzyme | 0.6 | — | — | 1.2 | — | 0.9 |
| Sodium tripolyphosphate | 25 | 36 | 25 | 35 | 50 | 30 |
| Magnesium sulphate | 0.5 | — | — | — | — | 0.4 |
| Additive composition | 2.5 | 2 | 1.5 | 3 | 2.2 | 1 |
| Sodium sulphate, moisture & miscellaneous | | | to 100 | | | |

In the above Examples XI to XVI, the additive compositions correspond to the compositions of Examples I to VI respectively.

The detergent compositions XI to XVI have improved characteristics with respect to photoactivator storage stability compared with corresponding compositions whereon the additive is free of the amorphous phosphate matrix material.

What we claim is:

1. A detergent additive composition in particulate form comprising:

(a) a storage-sensitive detergent additive material releasably enclosed within (b) a water-soluble glassy matrix of amorphous phosphate having the general formula I:

$$(M_2O)_x(P_2O_5)_y \quad \text{I}$$

wherein M is selected from the group consisting of hydrogen, alkali metal, ammonium and substituted ammonium groups, y has a value in the range from 2 to 50, and the ratio x:y is from 0.7:1 to 1.7:1; wherein said storage sensitive detergent additive material is a multifunctional photoactivator/dye which is a porphine having the general formula II:

II

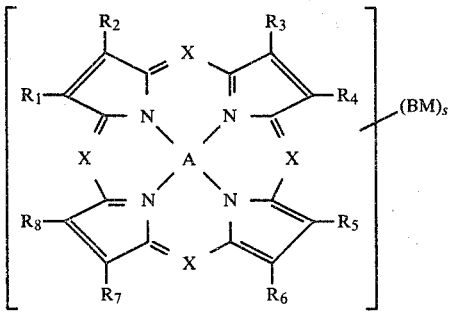

wherein each X is (=N—) or (=CY—), and the total number of (=N—) groups is 0, 1, 2, 3 or 4; wherein each Y, independently, is hydrogen or meso substituted alkyl, cycloalkyl, aralkyl, aryl, alkaryl or heteroaryl; wherein each R, independently, is hydrogen or pyrrole substituted alkyl, cycloalkyl, aralkyl, aryl, alkaryl or heteroraryl, or wherein adjacent pairs of R's are joined together with ortho-arylene groups to form pyrrole substituted alicyclic or heterocyclic rings; wherein A is 2(H) atoms bonded to diagonally opposite nitrogen atoms, or Zn(II), Cd(II), Mg(II), Ca(II), Al(III), Sc(III), or Sn(IV); wherein B is an anionic, nonionic or cationic solubilizing group substituted into Y or R; wherein M is a counterion to the solubilizing groups; and wherein s is the number of solubilizing groups; wherein, when B is cationic, M is an anion and s is from 1 to 8; when B is nonionic, B is polyethoxylate, M is zero, s is from 1 to 8, and the number of condensed ethylene oxide molecules per porphine molecule is from 8 to 50; when B is anionic and proximate, M is cationic and s is from 3 to 8; when B is anionic and remote, M is cationic and s is from 2 to 8; and when B is sulphonate the number of sulphonate groups is no greater than the number of aromatic and heterocyclic substituent groups.

2. A composition according to claim 1 wherein the porphine is selected from the group consisting of zinc phthalocyanine tri-and tetra-sulphonates and mixtures thereof.

3. A composition according to claim 1 wherein the amorphous phosphate has a y value in the range from 3 to 30 and an x:y ratio in the range from 0.85 to 1.5.

4. A composition according to claim 3 wherein the amorphous phosphate has a y value in the range from 6 to 15 and an x:y ratio in the range from 1 to 1.3.

5. A composition according to any of claims 1, 3 or 4 wherein the amorphous phosphate has a dissolution rate in distilled water at 25° C. such that the time for 90% dissolution of the phosphate, in the form of particles of seive size thru' 20# on 30# mesh, is in the range from 5 minutes to 2 hours.

6. A composition according to claim 5, wherein the dissolution rate is such that the time for 90% dissolution of the phosphate is in the range from 8 minutes to 20 minutes.

7. A composition according to claim 1 wherein the particles thereof comprise from 1% to 15% by weight thereof of the amorphous phosphate of formula I.

8. A composition according to claim 7, wherein said particles comprise from 3% to 10% by weight thereof of the amorphous phosphate of formula I.

9. A composition according to claim 1 wherein the storage-sensitive detergent additive is in intimate mixture with a hydratable water-soluble crystalline salt, the intimate mixture being releasably enclosed within a substantially continuous glassy matrix of amorphous phosphate material having the general formula I.

10. A composition according to claim 1 for addition to a detergent composition comprising a nonionic surfactant wherein the storage-sensitive detergent additive is a porphine of general formula II and wherein the rate of bleed of said porphine from said particulate detergent additive composition into a mixed solvent system containing the nonionic surfactant and water in a 100:6 ratio at 40° C., is less by a factor of at least 3 than the rate for the corresponding additive composition free of amorphous phosphate.

11. A granular detergent composition comprising from 0.1% to 20% thereof of a detergent additive composition in particulate form comprising:

(a) a storage-sensitive detergent additive material releasably enclosed within (b) a water-soluble glassy matrix of amorphous phosphate having the general formula I:

$$(M_2O)_x(P_2O_5)_y \qquad \text{I}$$

wherein M is selected from the group consisting of hydrogen, alkali metal, ammonium and substituted ammonium groups, y has a value in the range from 2 to 50, and the ratio x:y is from 0.7:1 to 1.7:1;

wherein said storage sensitive detergent additive material is a multifunctional photoactivator/dye which is a porphine having the general formula II:

II

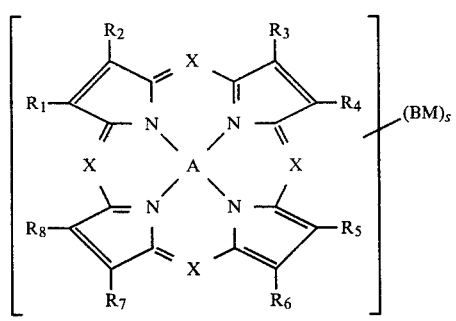

wherein each X is (=N—) or (=CY—), and the total number of (=N—) groups is 0, 1, 2, 3 or 4; wherein each Y, independently, is hydrogen or meso substituted alkyl, cycloalkyl, aralkyl, aryl, alkaryl or heteroaryl; wherein each R, independently, is hydrogen or pyrrole substituted alkyl, cycloalkyl, aralkyl, aryl, alkaryl or heteroraryl, or wherein adjacent pairs of R's are joined together with ortho-arylene groups to form pyrrole substituted alicyclic or heterocyclic rings; wherein A is 2(H) atoms bonded to diagonally opposite nitrogen atoms, or Zn(II), Cd(II), Mg(II), Ca(II), Al(III), Sc(III), or Sn(IV); wherein B is an anionic, nonionic or cationic solubilizing group substituted into Y or R; wherein M is a counterion to the solubilizing groups; and wherein s is the number of solubilizing groups; wherein, when B is cationic, M is an anion and s is from 1 to 8; when B is nonionic, B is polyethoxylate, M is zero, s is from 1 to 8, and the number of condensed ethylene oxide molecules per porphine molecule is from 8 to 50; when B is anionic and proximate, M is cationic and s is from 3 to 8; when B is anionic and remote, M is cationic and s is from 2 to 8; and when B is sulphonate the number of sulphonate groups is no greater than the number of aromatic and heterocyclic substituent groups.

12. A composition according to claim 11 wherein the porphine is selected from the group consisting of zinc phthalocyanine tri-and tetra-sulphonates and mixtures thereof.

13. A composition according to claim 11 wherein the amorphous phosphate has a y value in the range from 3 to 30 and an x:y ratio in the range from 0.85 to 1.5.

14. A composition according to claim 13 wherein the amorphous phosphate has a y value in the range from 6 to 15 and an x:y ratio in the range from 1 to 1.3.

15. A composition according to any of claims 11, 19 or 20 wherein the amorphous phosphate has a dissolution rate in distilled water at 25° C. such that the time for 90% dissolution of the phosphate, in the form of particles of sieve size thru' 20# on 30# mesh, is in the range from 5 minutes to 2 hours.

16. A composition according to claim 15, wherein the dissolution rate is such that the time for 90% dissolution of the phosphate is in the range from 8 minutes to 20 minutes.

17. A composition according to claim 11 wherein the particles of detergent additive compositions comprise from 1% to 15% by weight thereof of the amorphous phosphate of formula I.

18. A composition according to claim 17, wherein said particles comprise from 3% to 10% by weight thereof of the amorphous phosphate of formula I.

19. A composition according to claim 11 wherein the storage-sensitive detergent additive is in intimate mixture with a hydratable water-soluble crystalline salt, the intimate mixture being releasably enclosed within a substantially continuous glassy matrix of amorphous phosphate material having the general formula I.

20. A granular detergent composition according to claim 11 comprising:

(a) from 40% to 87.9% of spray-dried base powder comprising
  (i) from 1% to 20% of organic surfactant selected from anionic, zwitterionic and ampholytic surfactants and mixtures thereof,
  (ii) from 5% to 81.9% of detergency builder, and
  (iii) from 5% to 18% moisture,
(b) from 0.1% to 20% of the detergent additive composition, and
(c) from 2% to 25% of ethoxylated nonionic surfactant in intimate mixture with the spray-dried base powder and detergent additive composition.

21. A composition according to claim 20 wherein the storage-sensitive detergent additive is a porphine of general formula II and wherein the rate of bleed of said porphine from said particulate detergent additive composition into a mixed solvent system containing the nonionic surfactant and water in a 100:6 ratio at 40° C., is less by a factor of at least 3 than the rate for the corresponding additive composition free of amorphous phosphate.

22. A method for making the detergent additive composition of claim 1 comprising the step of spraying an aqueous solution comprising the amorphous phosphate onto moving granules of a mixture of the storage-sensitive detergent additive material and a hydratable water-soluble salt, thereby enrobing the additive material with a continuous glassy matrix of the amorphous phosphate.

* * * * *

UNITED STATES PATENT AND TRADEMARK OFFICE

CERTIFICATE OF CORRECTION

PATENT NO. : 4,417,994

DATED : November 29, 1983

INVENTOR(S) : Barry Stoddart

It is certified that error appears in the above-identified patent and that said Letters Patent are hereby corrected as shown below:

Claim 15, lines 1 and 2, "19 or 20" should be --13 or 14--.

Signed and Sealed this

*Twenty-fourth* Day of *January 1984*

[SEAL]

*Attest:*

GERALD J. MOSSINGHOFF

*Attesting Officer*

*Commissioner of Patents and Trademarks*